United States Patent [19]

Kuehn, III

[11] 4,036,200

[45] July 19, 1977

[54] CAPACITOR DISCHARGE IGNITION CIRCUIT

[75] Inventor: Andrew Kuehn, III, St. Paul, Minn.

[73] Assignee: Systematics, Inc., St. Paul, Minn.

[21] Appl. No.: 612,369

[22] Filed: Sept. 11, 1975

Related U.S. Application Data

[60] Continuation of Ser. No. 516,584, Oct. 21, 1974, abandoned, which is a continuation of Ser. No. 394,759, Sept. 6, 1973, abandoned, which is a continuation of Ser. No. 216,528, Jan. 10, 1972, abandoned, which is a division of Ser. No. 62,398, Aug. 10, 1970, Pat. No. 3,654,910.

[51] Int. Cl.[2] ..... F02P 1/00

[52] U.S. Cl. ..... 123/148 E; 123/148 CB; 123/198 DC

[58] Field of Search ..... 123/179 BG, 148 E, 148 CB, 123/148 DC, 198 DC

[56] References Cited

U.S. PATENT DOCUMENTS

| | | | |
|---|---|---|---|
| 3,312,860 | 4/1967 | Strum | 315/209 X |
| 3,418,988 | 12/1968 | Lewis et al. | 123/148 E |
| 3,487,822 | 1/1970 | Hufton et al. | 123/148 E |
| 3,500,808 | 3/1970 | Ilinski | 123/148 |
| 3,546,528 | 12/1970 | Fisher | 315/209 |
| 3,636,936 | 1/1972 | Schuette | 123/179 BG |
| 3,654,910 | 4/1972 | Kuehn | 123/148 |
| 3,882,840 | 5/1975 | Adamian et al. | 123/148 E |

*Primary Examiner*—C. J. Husar
*Assistant Examiner*—Paul Devinsky
*Attorney, Agent, or Firm*—Orrin M. Haugen

[57] ABSTRACT

An emission control circuit for an internal combustion engine having a voltage generating circuit connected to a source of direct current energy at a first potential for generating an output voltage of a substantially higher potential, the voltage generating circuit including energy storage means coupled to the output of the voltage generating means for storing an electrical charge. A triggerable switching means is provided for coupling the energy storage means in series with the primary winding of an induction coil, and triggering means responsive to the opening and closing of ignition breaker points is provided for applying triggering signals to the triggerable switching means. The triggering signals accommodate discharging of the energy storage means through the primary winding for a certain predetermined time period. A comparator circuit is provided which includes two semiconductor amplifier circuits, each having a pair of output electrodes and a control electrode. The comparator circuit is operable for inhibiting the triggering signals upon opening of the key switch, thus preventing triggering of the triggerable switching means when the key switch is opened.

2 Claims, 1 Drawing Figure

CAPACITOR DISCHARGE IGNITION CIRCUIT

CROSS-REFERENCE TO RELATED APPLICATIONS

The present application is a continuation of my co-pending application Ser. No. 516,584, filed Oct. 21, 1974, now abandoned which application was a continuation of my co-pending application Ser. No. 394,759, filed Sept. 6, 1973, now abandoned; and which application was a continuation of my co-pending application Ser. No. 216,528, filed Jan. 10, 1972, now abandoned; which application was a division of my parent application Ser. No. 62,398, filed Aug. 10, 1970, now U.S. Pat. No. 3,654,910, for "CAPACITOR DISCHARGE IGNITION CIRCUIT".

BACKGROUND OF THE INVENTION

This invention relates generally to an ignition control circuit for an internal combustion engine and more specifically to a solid state capacitor discharge ignition unit which functions to generate an intermediate voltage during one ignition firing cycle of the system which is then discharged through the ignition coil during the next succeeding ignition firing cycle. The intermediate voltage is at a potential substantially higher than the engine's battery potential, but is also substantially less than the voltage developed across the secondary winding of the ignition coil. This intermediate voltage is of a magnitude to give sufficient firing voltage to the engine spark plugs by direct transformation of voltage levels by the ignition coil such that the coil acts essentially as a pulse transformer rather than as an inductor with transformation.

The system offers the advantage of maintaining a substantially constant transfer of energy for varying states of battery charge. Further, the use of a transistorized triggering circuit for the semiconductor switch used to discharge the stored energy through the ignition coil, provides a more positively shaped pulse for triggering, with this in turn providing a high ignition voltage to be available during cranking. Also, by providing a variable timing control for the triggering circuit, a special "retard" function is obtained that is adjustable to fit specific engine requirements.

These and other objects and advantages will become apparent to those skilled in the art upon reading the following detailed description of the accompanying drawing.

DESCRIPTION OF THE PREFERRED EMBODIMENT

Figure 1:
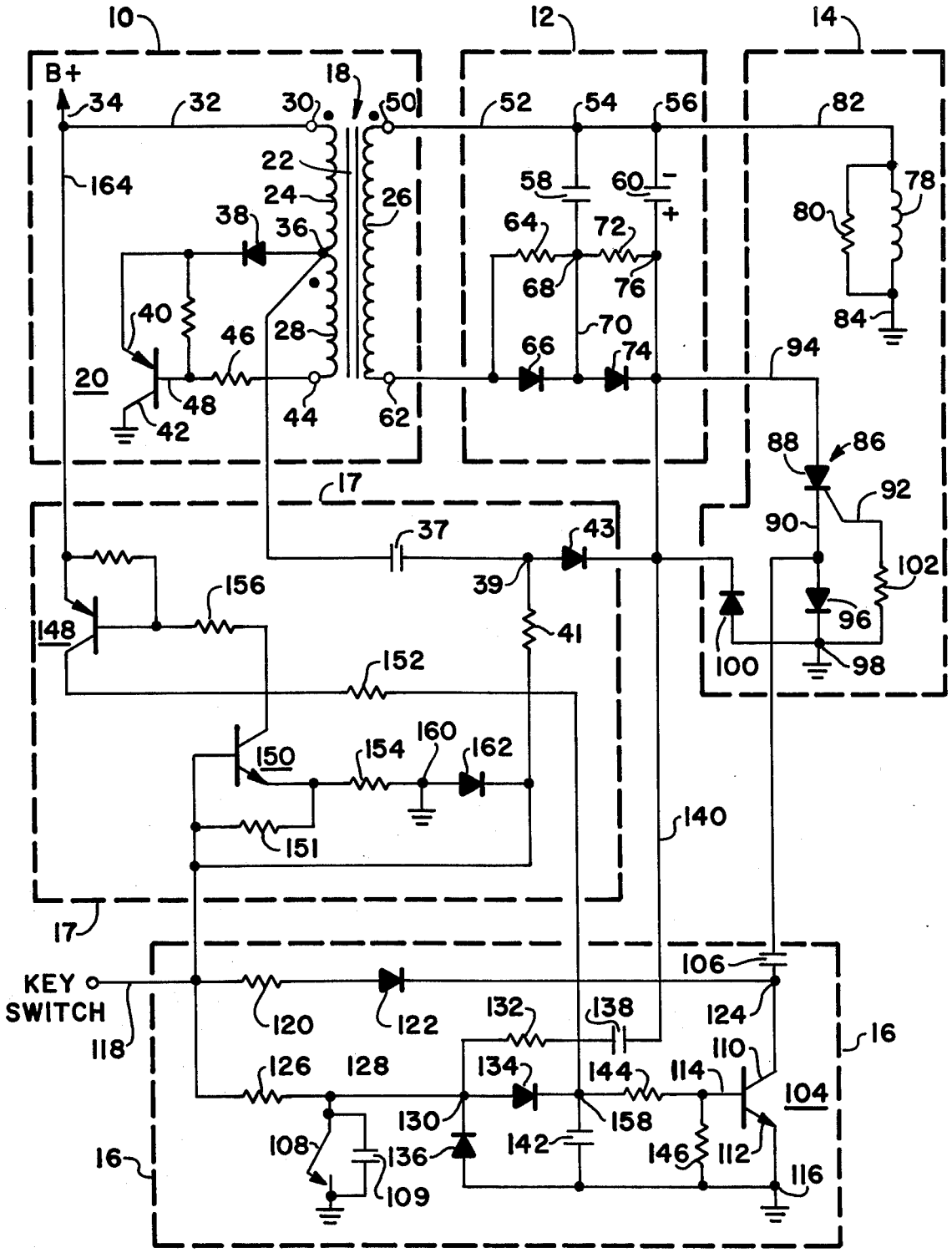
FIG. 1, the only figure in the case, is a schematic diagram of a preferred embodiment of the capacitor discharge ignition circuit of the present invention.

Referring now to FIG. 1 in which is shown a schematic diagram of the capacitor discharge ignition circuit, this circuit comprising an energy generation circuit shown enclosed by dashed line 10, an energy storage circuit enclosed by dashed line 12, a discharge circuit shown enclosed by dashed line 14, and a triggering circuit shown enclosed by dashed line 16.

Referring first to the energy generation circuit 10, this portion of the system comprises a transformer indicated generally by numeral 18 and a transistor amplifier indicated generally by numeral 20. The transformer 18 includes a saturable core 22 on which is wound a primary winding 24, a secondary winding 26 and a feedback winding 28. Primary winding 24 has a first terminal 30 connected by a conductor 32 to a terminal 34. The second terminal 36 of primary winding 24 is connected through a semiconductor diode 38 to the emitter electrode 40 of transistor amplifier 20. The collector electrode 42 of transistor 20 is connected to a point of fixed potential (ground). One terminal of the feedback winding 28 is also connected to the the terminal 36 with the other terminal 44 of feedback winding 28 being connected through a resistor 46 to the base electrode 48 of transistor amplifier 20. The terminal 34 is adapted to be connected to the positive terminal of the direct current storage battery normally associated with the engine. The negative terminal of the battery is connected to ground.

The secondary winding 26 of transformer 18 has a first terminal 50 connected by a conductor 52 to first terminals 54 and 56 of a pair of condensers 58 and 60. The condensers 58 and 60 comprise the significant portion of the energy storage circuit 12. The other terminal 62 of secondary winding 26 is coupled by means of a parallel circuit including a resistor 64 and diode 66 to the other terminal 68 of condenser 58, terminal 68 forming a junction. The cathode electrode of diode 66 is connected to terminal or junction 68 by conductor 70. A parallel circuit including resistor 72 and diode 74 is disposed between the junction 68 and the other terminal 76 of condenser 60, terminal 76 also forming a junction.

The energy discharge circuit 14 includes the load 78 which in this instance comprises the primary winding of the induction coil of the ignition system, with resistor 80 being connected in parallel with the primary winding 78. The parallel combination of resistor 80 and primary winding 78 is connected by a conductor 82 to the junction 56 and to ground by a conductor 84. Further included in the discharge circuit is a silicon controlled rectifier (SCR) indicated generally by numeral 86 having an anode electrode 88, a cathode electrode 90 and a trigger electrode 92. The anode 88 is connected by a conductor 94 to the junction 76. The cathode electrode 90 is coupled through diode 96 to a grounded termainal 98. Terminal 98 is also coupled through diode 100 to the junction 76. Further, a resistor 102 connects the trigger electrode 92 of the silicon controlled rectifier 86 to the grounded terminal 98.

Included in the triggering circuit shown enclosed by dashed line 16 is a semiconductor switching device indicated generally by numeral 104, a capacitor 106, the ignition system breaker points 108 with the conventional capacitor 109, optionally utilized, as well as other components interconnecting these principal components of the triggering circuit.

More specifically, the semiconductor switching device 104 (here shown as a NPN transistor) has a pair of output electrodes 110 and 112 and a control electrode 114. The output electrodes 110 and 112 are connected in series with the capacitor 106 between a grounded terminal 116 and the cathode electrode 90 of the silicon controlled rectifier switching device 86. A key switch terminal 118 is adapted to be connected through a conventional charge indicator and a key operated switch to a source of positive potential which may be the positive terminal of the engine's storage battery. The charge indicator includes a comparator which compares the engine's alternator output with the battery voltage and indicates when current is being drawn from the battery rather than from the alternator. Terminal 118 is coupled through a resistor 120 and a diode 122 to a junction 124 between the collector electrode 110 of semiconductor switching device 104 and a terminal of the capacitor 106. The key switch terminal 118 is also coupled through a resistor 126 to the ungrounded terminal 128 of the breaker points 108. This ungrounded terminal 128 is also coupled to a junction 130 formed between first terminals of a resistor 132, the anode of diode 134 and the cathode of diode 136. The other terminal of resistor 132 is coupled through a capacitor 138 by a conductor 140 to the junction 76. A capacitor 142 is coupled across the other terminals of the diodes 134 and 136, the cathode and anode respectively. A resistor 144 couples the junction between the capacitor 142 and the diode 134 to the base or control electrode 114 of the semiconductor switching device 104. A resistor 146 is connected between the control electrode 114 and the grounded terminal 116 of the semiconductor switching device 104.

The on-off control circuit of the system, shown by dashed line 17 includes a first transistor amplifier 148, a second transistor amplifier 150 and the coupling resistors 152, 154 and 156. The resistor 152 couples the collector electrode of transistor amplifier 148 to the junction 158 formed between the anode of diode 134 and a terminal of resistor 144. Coupling resistor 154 connects the emitter electrode of transistor amplifier 150 to a ground terminal 160. Ground terminal 160 is coupled through a diode 162 to the key switch terminal 118. Finally, the coupling resistor 156 connects the collector electrode of transistor 150 to the base electrode of transistor amplifier 148. The emitter electrode of transistor 148 is coupled to the positive terminal of the battery by means of conductor 164. A resistor 153 couples the emitter of transistor 148 to its base electrode. Resistors 153 and 156 form a voltage divider and controls the turn-on threshold of transistor 148.

The junction 36 between the primary winding 24 and the feedback winding 28 of transformer 18 is coupled through a capacitor 37 to a junction point 39 to which is connected a first terminal of a resistor 41 and the anode electrode of a diode 43. The cathode of diode 43 is connected to the junction 76.

Now that the details of the circuit components and interconnections thereof have been set forth in detail, consideration will be given to the mode of operation of the preferred embodiment of the present invention.

OPERATION

The general purpose of this system is to generate an intermediate voltage during one firing cycle of the engine's ignition system that is discharged during the next firing cycle through the ignition coil. The intermediate voltage is of a magnitude to give sufficient firing voltage through the spark plugs of the engine due to direct transformation of voltage levels by the ignition coil. With this arrangement, the coil then becomes a pulse transformer instead of being an inductor with transformation as it is in prior art systems.

Initially, it is to be assumed that the positive terminal of the battery used with the system is connected to the terminal 34 while the negative terminal of the battery is connected to ground. The energy generation circuit 10 functions to convert battery power to an intermediate voltage which is at a higher level than that of the battery. This higher intermediate voltage is stored in the energy storage circuit 12 for later discharge through the ignition coil 78. The energy generation circuit includes the transformer 18 and the semiconductor amplifier 20.

When the key switch which is coupled to terminal 118 by way of an ignition ballast resistor (not shown) is turned on, current flows through resistor 41 and diode 43 to charge the capacitor 60 in the manner indicated by the polarity markings adjacent to it. When capacitor 60 is discharged through the discharge circuit 14, in a manner to be described hereinbelow, a current pulse is drawn through the capacitor 37 from the battery terminal 34 through the primary winding 24 through the capacitor 37 and the diode 43, through conductor 94 and the silicon control recrtifier 86 and diode 96 to ground. The flow of current through the primary winding produced by this pulse induces a voltage in the feedback winding 28 of transformer 18 and this feedback voltage is of a polarity (see polarity markings on the transformer) to render the transistor amplifier 20 more heavily conducting. This lowers the impedance of the amplifier 20 thereby permitting a greater current flow through the conductor 32, the primary winding 24, the diode 38 and the emitter to collector path of the transistor amplifier 20. Thus, it can be seen that the feedback winding and the transistor act in a re-generative fashion to produce rapid saturation of the saturable core transformer 18. The flow of current through the primary winding 24 and the transistor amplifier 20 continues until the transformer core is near saturation at which time the feedback current produced by the feedback winding 28 is markedly decreased. The transistor then cuts off and current ceases to flow through the primary winding 24.

During this period of re-generative action prior to transformer saturation, very little current flows in the secondary winding 26. As soon as the current through the primary winding 24 cuts off due to saturation, the energy stored in the primary inductance is transformed to the secondary winding 26, first flowing through diode 66 and conductor 70 to charge capacitor 58. When the charge on capacitor 58 equals the residual charge on capacitor 60, the current flowing through the secondary winding 26 flows through diode 66, diode 74 to charge capacitors 60 and 58. The resistor 64 connected in parallel with the diode 66 serves as a bleed resistor for capacitor 58 to allow this capacitor to charge in the direction of induced voltage during primary winding current flow. This allows the secondary current to flow in the direction of diode polarity immediately upon turn-off of the current flow through the primary winding occasioned by transformer saturation. The action of the bleed resistor 64 then reduces the turnoff voltage reflected to the primary winding and applied across the emitter to collector junction of transistor 20 to an acceptable level, thereby preventing voltage breakdown of the transistor.

Transistor 20 is preferably low voltage, high conduction transistor, such as a high current germanium unit. By using diode 38 in series with the emitter-base circuit of transistor 20, any transistor leakage at elevated temperatures acts as a reverse bias further restraining the leakage flow. The diode 38 also serves the function of providing a fixed voltage off-set in the feedback circuit to thereby minimize the chance of the inductance of the primary winding resonating with circuit capacity to produce self-oscillations.

The above cycle of operation repeats itself for each firing of the silicon controlled rectifier (SCR) 86, thus recharging the capacitor 60 to the desired potential after each firing event.

The resistor 72 serves to bleed off the charge on capacitor 60 when the system is shut down.

The resistor 80 connected in parallel with the primary winding of the induction coil 78 is a protecting resistor which provides a discharge path for the capacitors 58 and 60 in the event the primary winding 78 is opened or disconnected. The value of resistor 80 is selected so as to permit the SCR to remain in conduction for a maximum period with minimum reduction of coil output so that the energy generation circuit will not be triggered while there is a significant voltage charge on capacitors 58 and 60. With a limited charge on the capacitors, the turn-off voltage on the primary winding of transformer 18 will be minimized at the termination of the re-generation cycle to thereby prevent voltage breakdown of transistor 20.

The trigger and discharge circuit enclosed by dashed line 14 serves to dump the charge stored in the capacitors 58 and 60 through the primary winding 78 of the ignition coil whenever the SCR 86 is triggered into conduction. Specifically, when SCR 86 is switched on so as to present a low impedance, the charge on capacitor 60 flows to the junction 76, through conductor 94 and from the anode 88 to cathode 90 electrodes of SCR 86, through diode 96 and conductor 84, through the primary winding 78 of the coil and a conductor 82 to the other terminal 56 of the capacitor 60. By using diode 96 poled as illustrated in the cathode to ground circuit, a negative pulse can be used to trigger the SCR into conduction.

The SCR 86 is turned on when a negative pulse from the capacitor 106 in the triggering circuit 16 is applied to the cathode electrode of the SCR. More specifically, when a negative pulse is applied to the cathode 90 of SCR 86, a current flows from ground 98 through the resistor 102 connected to the gate electrode 92 of the SCR. As mentioned above, this turns the SCR on and permits the substantially larger discharge current from the capacitor 60 to flow therethrough and through the primary winding 78 of the ignition coil.

Because the ignition coil is inductive in nature, the current flow cannot cease immediately upon the discharge of capacitors 58 and 60. Current continues to flow until a peak reverse voltage appears on capacitors 58 and 60. At this point, capacitor 60 only reverses the direction of current flow through the ignition coil and through the diode 100 unit it is charged in a forward direction to a voltage which is a function of the unused energy recovered from this cycle of oscillation. During the reverse flow, SCR 86 is rendered non-conductive and, since the pulse has been removed from its gate electrode 92, SCR 86 clamps off and traps the residual charge on the capacitor 60. Capacitor 58, however, remains reverse charged to aid in removing voltage transients from the energy generation circuit 10. Resistor 132 and capacitor 138 tend to reduce the reapplication of potential to SCR 86 for triggering purposes.

To provide reliable triggering of the SCR 86 under all operating conditions, a negative pulse triggering circuit 16 was provided. As is illustrated, the triggering circuit consists of resistor 120, diode 122, capacitor 106, resistor 102, diode 96 and semiconductor switch 104 which creates a principal firing pulse while resistor 126, the breaker points 108, diode 134, diode 136, resistor 144, resistor 146, and capacitor 142 control the conduction state of the semiconducting switching device 104.

When the key switch coupled to terminal 118 is turned on, current also flows from the source of positive potential, e.g., the engine's alternator through resistor 120 and diode 122, through capacitor 106 diode 96 to charge the capacitor 106 when the breaker points 108 are closed. When the points open, current flows from the key switch terminal 118 through resistor 126, through diode 134 charging capacitor 142. Current also flows through the resistor 144 and through the base 114 to emitter 112 circuit portion of transistor 104 which is connected in parallel with the resistor 146. The various component values are chosen to give a conduction rise rate for the base circuit of transistor 104 that insures a fast flow of current from ground through resistor 102, the gate to cathode junction of SCR 86, through capacitor 106 and transistor 104 to ground. Once the capacitor 106 is discharged, the collector electrode 110 of transistor 104 remains at essentially ground potential to prevent variations in the key switch terminal voltage from re-triggering SCR 86 while the points 108 are open.

When the points 108 reclose, the charge on capacitor 142 maintains conduction in the base circuit of transistor 104 for a predetermined limited period to allow the points to come to rest, thereby ovbiating problems which may otherwise be caused by contact bounce. After this predetermined period has lapsed, conduction of current through transistor 104 ceases, and diode 134 blocks any back-flow of current to the points. When the transistor 104 is cut off, capacitor 106 again recharges in the manner previously described through resistor 120 and diode 122. The diode 122 provides a blocking action that allows capacitor 106 to take on the highest voltage applied to this circuit during the period in which the points 108 are closed. This offers an advantage in cold weather, especially during engine cranking when the battery voltage just before firing is at its lowest point.

The diode 136 serves as a by-pass for high potential signals that may be reflected back from the distributor during periods of high spark potential requirements. It protects diode 134 from voltage breakdown.

On some motor vehicles even after the key switch is opened, a residual voltage may be fed back from the altinator to the ignition circuit when the engine is still rotating. This may be attributed to the voltage comparator circuit associated with the charge indicator light on the instrument panel which serves to indicate that the engine's generating system is in a charging mode. Specifically, a current path exists between the alternator and the key switch terminal 118. It has been found that this residual voltage may be at a sufficiently high level to provide sufficient charging current in capacitor 106 to continue firing the SCR 86. To obviate this problem and to insure that firing cannot take place subsequent to the opening of the key switch, the on-off control circuit 17 is provided. Circuit 17 comprises a voltage comparator circuit which senses when the key voltage at the switch terminal drops below a predetermined reference levels as compared to the battery voltage. When this happerns, current flows continuously to the base of transistor 104 and prevents the capacitor 106 from recharging, thus turning off the system.

With the key switch on, current flows from the engine's alternator (coupled to terminal 118) through the base to emitter junction of transistor amplifier 150 thereby placing it in a conductive state. Since there is no resistor in the base circuit of the transistor, the voltage across resistor 154 is essentially equal to the battery voltage i.e., battery voltage less the small drop across the ignition ballast resistor and the base-emitter drop of transistor 150. Typically, these drops may be in the range of 0.5 volt to 1.5 volts. Resistor 151 serves to stabilize the "off" condition of transistor 150 when the key switch connected to terminal 118 is open and diode 162 provides a by-pass of any induction transient signals which may be occasioned by the opening of the key switch to prevent damage to transistor 150.

When the key switch voltage drops significantly below the battery voltage which occurs when the key switch is opened, the drop across resistor 153 increases and transistor 148 turns on. Current will flow from the battery terminal 34 through the emitter to base junction of transistor amplifier 148, through resistor 156, through the collector to emitter path of transistor 150 and through resistor 154 to the ground terminal 160. This provides current flow through the emitter to collector path of transistor 148 through the resistor 152 and through resistor 144 to the base circuit of transistor 104. This flow is continuous under the assumed condition and prevents capacitor 106 from charging hence the normal charging current for capacitor 106 which normally flows through resistor 120 and diode 122 is shunted to ground through the collector to emitter path of transistor 104. If the key switch terminal voltage is zero which occurs when the alternator ceases to be driven, no current can flow to capacitor 106 through the key switch, thus transistors 148 and 150 need only function between predetermined key switch voltage levels below battery voltage to a level which is insufficient to trigger the SCR 86 into conduction.

It is to be noted that by connecting the circuit from batter terminal 34 to the junction 158 which is common to capacitor 142 and resistor 144, the capacitor 142 serves as a filter for any short duration transient pulses introduced into the key switch circuit that might cause transistor 148 to conduct when the engine is running and the points are closed.

While the circuit forming the preferred embodiment of this invention whereby transistorized control of the SCR triggering circuit is employed, gives a more positive shaped pulse for triggering, and has the advantage of "locking" in the highest available voltage during cranking. Also, it allows one to continue using the conventional capacitor across the breaker points in the ignition system, making the system easily converted from a "discharge ignition" to conventional ignition for servicing the system. Furthermore, by providing a fixed delay in restoring the charge on the capacitor 106, the effect of contact bounce is eliminated instead of merely being filtered out. Hence, double firing of the SCR is avoided.

While there has been described and illustrated a preferred embodiment of this invention, it will become apparent to those skilled in the art that various modifications and changes can be made. For example, if a positive ground system is desired, it is advantageous to discharge the capacitor 60 through a gated semiconductor switch (SCR 86) to ground then through the primary winding of the induction coil. In this way, any moisture or leakage path to ground on the primary winding of the induction coil would not cause capacitor 60 to be discharged between firings. For a positive ground system, it is only necessary that the polarities of all semiconductors be reversed and that the battery polarity be reversed. The SCR device in the form of a triac or other bi-polar device may be utilized, may still be triggered either negatively or positively using principles set forth in the foregoing specification. Accordingly, the invention described herein should only be limited in accordance with the scope of the appended claims.

I claim:

1. In a capacitive discharge ignition circuit of the type including an ignition coil, a direct current source including a storage battery, a set of distributor points a capacitive energy storage circuit coupled to said battery, an electronic switching means for coupling said energy storage circuit to said ignition coil each time said electronic switching means is triggered, a trigger circuit coupled to said electronic switching means for normally producing trigger signals for operating said electronic switching means each time the distributor points open, and an ignition key switch terminal coupled to said direct current source, and comparator means for preventing the triggering of said electronic switch means after the key switch has been opened comprising:

a. a first and a second semiconductor amplifier circuit each having a pair of output electrodes and a control electrode;

b. means coupling said pair of output electrodes of said first semiconductor amplifier in series between one terminal of said battery and said trigger circuit;

c. means connecting the output electrodes of said second semiconductor amplifier between the control electrode of said first semiconductor amplifier and the other terminal of said battery; and d. means connecting the control electrode of said semiconductor amplifier to said key switch terminal, whereby said comprising means is operable for inhibiting said trigger circuit from producing said trigger signals when the voltage from said source of direct current falls below a predetermined threshold following the opening of said key switch.

2. An improved ignition control circuit for an internal combustion engine comprising:

a. a voltage generating circuit connected through a keyswitch to a source of direct current at a first potential for generating an output voltage of a substantially higher potential;

b. energy storage means coupled to said output of said voltage generating means for at least temporarily storing an electrical charge;

c. means including triggerable switching means for coupling said energy storage means in series with the primary winding of an induction coil;

d. triggering means responsive to the opening and closing of ignition breaker points for applying triggering signals to said triggerable switching means said triggering signals switching said triggerable switching means for discharging, the charge in said energy storage means through said primary winding for a predetermined time period;

e. comparator means coupled to said source of direct current and to said triggering means for inhibiting said triggering signals when said source of direct current falls below a predetermined threshold following the opening of said key switch for preventing the triggering of said triggerable switching means after the key switch has been opened, comparator means comprising;

f. a first and a second semiconductor amplifier circuit each having a pair of output electrodes and a control electrode;

g. means coupling said pair of output electrodes of said first semiconductor amplifier in series between said source of direct current and said trigger circuit;

h. means connecting the output electrodes of said second semiconductor amplifier between the control electrode of said first semiconductor amplifier and a point of fixed potential; and h. means coupling the control electrode of said second semiconductor amplifier to a voltage source to be monitored.

* * * * *

UNITED STATES PATENT OFFICE

CERTIFICATE OF CORRECTION

PATENT NO. : 4,036,200

DATED : July 19, 1977

INVENTOR(S) : Andrew Kuehn III

It is certified that error appears in the above-identified patent and that said Letters Patent are hereby corrected as shown below:

Column 6, line 57, "when the key voltage at the" should read -- when the voltage at the key --.

Column 7, line 10, after the word "switch" insert -- terminal --.

Column 8, line 34, "comprising" should read -- comparator --.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*